US009062439B2

(12) United States Patent
Lee

(10) Patent No.: US 9,062,439 B2
(45) Date of Patent: Jun. 23, 2015

(54) TEMPERATURE DISPLAYING DEVICE FOR FAUCET

(71) Applicant: SAYDOEASY CO., LTD., Taoyuan County (TW)

(72) Inventor: Kai-hsi Lee, Toayuan County (TW)

(73) Assignee: SAYDOEASY CO., LTD., Taoyuan County (TW)

( * ) Notice: Subject to any disclaimer, the term of this patent is extended or adjusted under 35 U.S.C. 154(b) by 78 days.

(21) Appl. No.: 13/942,216

(22) Filed: Jul. 15, 2013

(65) Prior Publication Data

US 2013/0299016 A1 Nov. 14, 2013

Related U.S. Application Data

(63) Continuation-in-part of application No. 13/197,389, filed on Aug. 3, 2011, now abandoned.

(30) Foreign Application Priority Data

Aug. 10, 2010 (TW) ..... 99215304 U

(51) Int. Cl.
*G08B 17/00* (2006.01)
*E03C 1/04* (2006.01)

(52) U.S. Cl.
CPC . *E03C 1/04* (2013.01); *E03C 1/041* (2013.01); *E03C 2001/0418* (2013.01)

(58) Field of Classification Search
None
See application file for complete search history.

(56) References Cited

U.S. PATENT DOCUMENTS

| | | | | |
|---|---|---|---|---|
| 5,845,844 | A | 12/1998 | Zosimodis | |
| 6,805,458 | B2 | 10/2004 | Schindler et al. | |
| 6,997,064 | B2 * | 2/2006 | Bird et al. | 73/861.75 |
| 7,252,431 | B1 | 8/2007 | Caramanna | |
| 7,257,999 | B2 * | 8/2007 | Goldfarb | 73/149 |
| 7,932,917 | B2 * | 4/2011 | Han et al. | 345/690 |
| 2004/0258567 | A1 * | 12/2004 | Kokin et al. | 422/68.1 |
| 2009/0323761 | A1 * | 12/2009 | Tsai | 374/148 |

FOREIGN PATENT DOCUMENTS

| | | | | |
|---|---|---|---|---|
| TW | M434912 | * | 8/2012 | F24H 9/20 |
| TW | M434913 | | 8/2012 | |

* cited by examiner

*Primary Examiner* — John A Tweel, Jr.
*Assistant Examiner* — Brian Wilson
(74) *Attorney, Agent, or Firm* — Huffman Law Group, PC

(57) ABSTRACT

A temperature displaying device for faucets or showerheads includes a pipe, a control unit, a temperature sensing unit coupled to the pipe, a display unit, a sound alert unit, and a power supply module. The pipe is connected to a water outlet end of a faucet or showerhead or disposed inside a tube of the faucet. The temperature sensing unit senses temperature of water running through the pipe and feeds back a sensing signal to the control unit, allowing the control unit to drive the display unit to display water temperature and drive the sound alert unit to give a sound alert. Accordingly, the temperature displaying device for faucets or showerheads displays water temperature and gives an alert in response to high water temperature.

10 Claims, 5 Drawing Sheets

TEMPERATURE DISPLAYING DEVICE FOR FAUCET

CROSS-REFERENCE TO RELATED APPLICATIONS

This application is a continuation-in-part application of application Ser. No. 13/197,389 filed on Aug. 3, 2011, currently pending, the entire contents of which are incorporated herein by reference.

FIELD OF THE INVENTION

The present invention relates to temperature displaying devices, and more particularly, to a temperature displaying device connected to a water outlet end of a faucet or showerhead or disposed in a pipe of the body of the faucet or showerhead for displaying water temperature and generating a sound alert.

DESCRIPTION OF THE PRIOR ART

A conventional faucet or showerhead is a device for starting a water flow, shutting down a water flow, and controlling a water flow, and is indispensable to the daily life of human beings. However, a conventional faucet or showerhead lacks a water temperature displaying function, and thus hot water running out of a conventional faucet or showerhead is likely to scald a careless consumer. To solve the above problem, the manufacturing sector developed water temperature displaying faucets or showerheads which are disposed at an appropriate position of a faucet or showerhead and adapted to display water temperature, so as to display the temperature of the hot water running out of the faucet. In this regard, conventional water temperature displaying faucets or showerheads are mostly connected to an external power supply and thus exposed to hazards, such as electrical leaks, and confronted with the need to be refitted or replaced. As a result, the burn prevention goal of the conventional water temperature displaying faucets or showerheads has not yet come true. In addition, although the conventional water temperature displaying faucets or showerheads are capable of displaying water temperature, they do not give any alert when the water temperature goes beyond a safe temperature threshold. If a consumer is negligent in keeping an eye on changes of water temperature, dangers may still happen. Furthermore, the conventional water temperature displaying faucets or showerheads are powered by batteries; hence, the odds are that dangers may still happen to those consumers who are negligent in changing batteries which have run out of power.

Accordingly, it is imperative to invent a faucet-specific temperature displaying device for displaying water temperature and giving a sound alert as needed when connected to a faucet, so as to prevent scalds.

BRIEF SUMMARY OF THE INVENTION

In view of the aforesaid drawbacks of the prior art, the inventor of the present invention conducted extensive researches and experiments according to the inventor's years of experience in the related industry, and finally developed a faucet-specific temperature displaying device as disclosed in the present invention to achieve the purposes of installing and operating the temperature displaying device easily, displaying water temperature, giving an alert in response to a high water temperature, as well as generating power and operating automatically.

It is a primary objective of the present invention to provide a temperature displaying device for faucets or showerheads. The temperature displaying device comprises a pipe, a control unit, a temperature sensing unit, a display unit, a sound alert unit, and a power supply module, and can operate by means of a combination thereof, such that the temperature displaying device is installed at the water outlet end of a faucet or showerhead or is directly installed in a tube of faucet or showerhead to thereby provide ease of installation and ease of use, display water temperature, and give an alert in response to a high water temperature.

It is a secondary objective of the present invention to provide a temperature displaying device for faucets or showerheads. The temperature displaying device further comprises a water flow power generator disposed in the pipe and/or a solar panel disposed outside the pipe for supplying power to the temperature displaying device and thereby meeting the requirement for automatic power generation and operation.

In order to achieve the above and other objectives, the present invention provides a temperature displaying device for faucets or showerheads, comprising: a pipe having a water inlet, a water outlet, and a water channel, the water inlet being disposed at an end of the pipe, the water outlet being disposed at another end of the pipe, and the water channel communicating with the water inlet and the water outlet; a control unit coupled to the pipe; a temperature sensing unit coupled to the pipe for sensing a temperature of water running through the pipe and electrically connected to the control unit for allowing a sensing signal to be fed back to the control unit; a display unit comprising a liquid crystal display coupled to the pipe and electrically connected to the control unit for displaying water temperature; a sound alert unit comprising a buzzer electrically connected to the control unit for giving a sound alert; and a power supply module electrically connected to the control unit for supplying power to the temperature displaying device.

The power supply module of the present invention comprises a water flow power generator disposed in the water channel of the pipe. The water flow power generator comprises a hydraulic wheel, a rotor coupled to the hydraulic wheel, and a stator corresponding in position to the rotor, such that water running through the pipe drives the hydraulic wheel to rotate and thereby causes the hydraulic wheel to synchronously drive the rotor to rotate, thereby allowing the rotor and the stator to generate power required for the temperature displaying device. In an embodiment of the present invention, the power supply module comprises a battery holder for accommodating a battery; the battery holder enables the battery to be connected to the control unit for supplying power to the temperature displaying device of the present invention. In an embodiment of the present invention, the power supply module comprises a solar panel; the solar panel generates the power required for the temperature displaying device. In addition to powering the displaying of water temperature, the water flow power generator or the solar panel is effective in charging the battery holder.

In an embodiment of the present invention, the pipe is integrally formed with a seat protruding from the pipe laterally. The seat accommodates the control unit, the display unit, and the sound alert unit.

Accordingly, as disclosed in the present invention, the temperature displaying device for faucets or showerheads works in a way described hereunder. The water inlet of the pipe is connected to the water outlet end of a faucet, such that water can run through the water channel of the pipe and flow out of the water outlet of the pipe; meanwhile, the temperature sensing unit senses the temperature of the water running through the pipe and feeds back a sensing signal to the control unit. Then, the control unit drives the liquid crystal display of the display unit to display water temperature. According to the present invention, once water temperature goes beyond a safe temperature threshold, the control unit will drive the buzzer of the sound alert unit to give a sound alert until the user lowers the water temperature to the safe temperature threshold. Accordingly, the temperature displaying device for faucets or showerheads of the present invention features ease of installation and ease of use, displays water temperature, and gives an alert in response to a high water temperature. Furthermore, the water flow power generator and/or the solar panel enables the temperature displaying device to generate power and operate automatically.

BRIEF DESCRIPTION OF THE SEVERAL VIEWS OF THE DRAWINGS

Objectives, features, and advantages of the present invention are hereunder illustrated with specific embodiments in conjunction with the accompanying drawings, in which.

DETAILED DESCRIPTION OF THE EMBODIMENTS OF THE INVENTION

Figure 1:
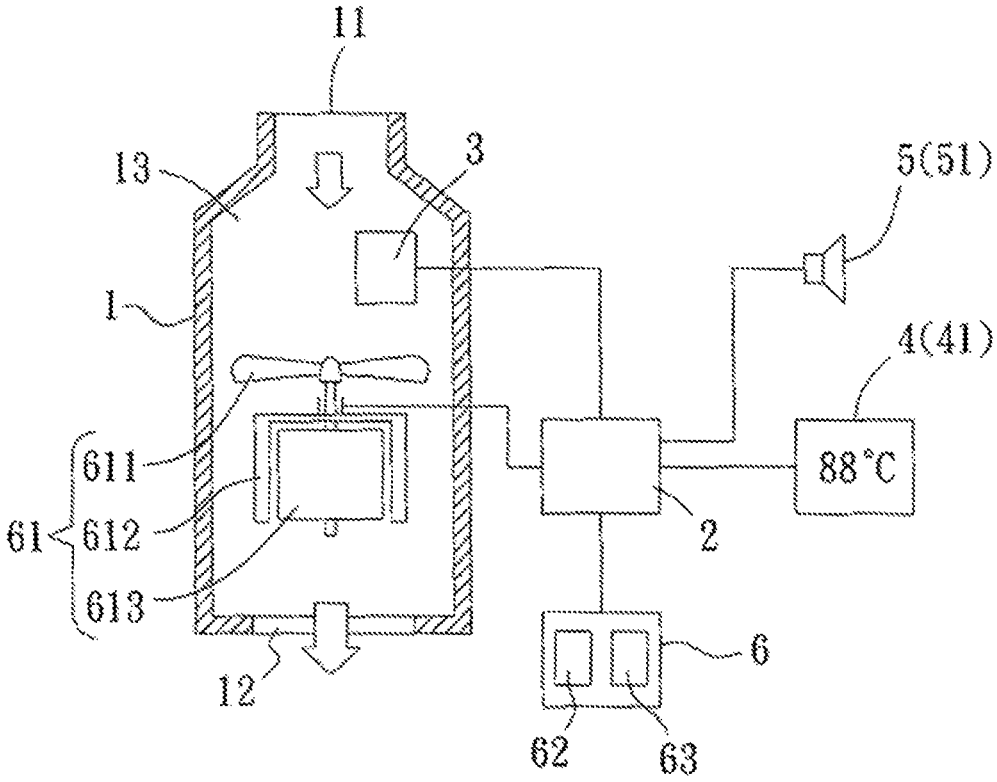
FIG. 1 is a schematic view of a temperature displaying device for faucets or showerheads according to a preferred embodiment of the present invention.

Referring to FIG. 1, there is shown a schematic view of a temperature displaying device for faucets or showerheads according to a preferred embodiment of the present invention. As shown in FIG. 1, the temperature displaying device comprises a pipe 1. The pipe 1 has a hollow core. The pipe 1 is either straight or curved. The pipe 1 is integrally formed as a unitary unit; alternatively, the pipe 1 consists of a plurality of sub-pipes connected together to form the pipe 1. The pipe 1 has one end formed with a water inlet 11 and the other end formed with a water outlet 12. Furthermore, the pipe 1 has a water channel 13 in communication with the water inlet 11 and the water outlet 12, such that the water inlet 11 can be connected to the water outlet end of a conventional faucet or showerhead (not shown). The temperature displaying device further comprises a control unit 2. The control unit 2 is coupled to the pipe 1 and comprises a circuit board and a required circuit in order for the control unit 2 to function as the control center of temperature displaying device. The temperature displaying device further comprises a temperature sensing unit 3. The temperature sensing unit 3 is coupled to the inside of the pipe 1; preferably, the temperature sensing unit 3 extends to the water channel 13 of the pipe 1 for sensing the temperature of the water running through the pipe 1. The temperature sensing unit 3 is electrically connected to the control unit 2 by a wire or by any other appropriate means, such that a sensing signal can be fed back by the temperature sensing unit 3 to the control unit 2. The temperature displaying device further comprises a display unit 4. The display unit 4 comprises a liquid crystal display 41. The liquid crystal display 41 is coupled to the pipe 1 from outside. The liquid crystal display 41 is electrically connected to the control unit 2 by a wire or by any other appropriate means. Hence, under the control of the control unit 2, the temperature of the water running through the pipe 1 is displayed. The temperature displaying device further comprises a sound alert unit 5. The sound alert unit 5 comprises a buzzer 51 coupled to the pipe 1 or the circuit board of the control unit 2. The buzzer 51 is electrically connected to the control unit 2. Under the control of the control unit 2, the buzzer 51 gives a sound alert. The temperature displaying device further comprises a power supply module 6. The power supply module 6 is coupled to the pipe 1 and electrically connected to the control unit 2 for supplying power to the temperature displaying device in operation. Hence, the temperature displaying device can be quickly connected to the water outlet end of a conventional faucet or showerhead (not shown) for displaying water temperature and giving an alert in response to a high temperature of the water running through the faucet.

Figure 2:
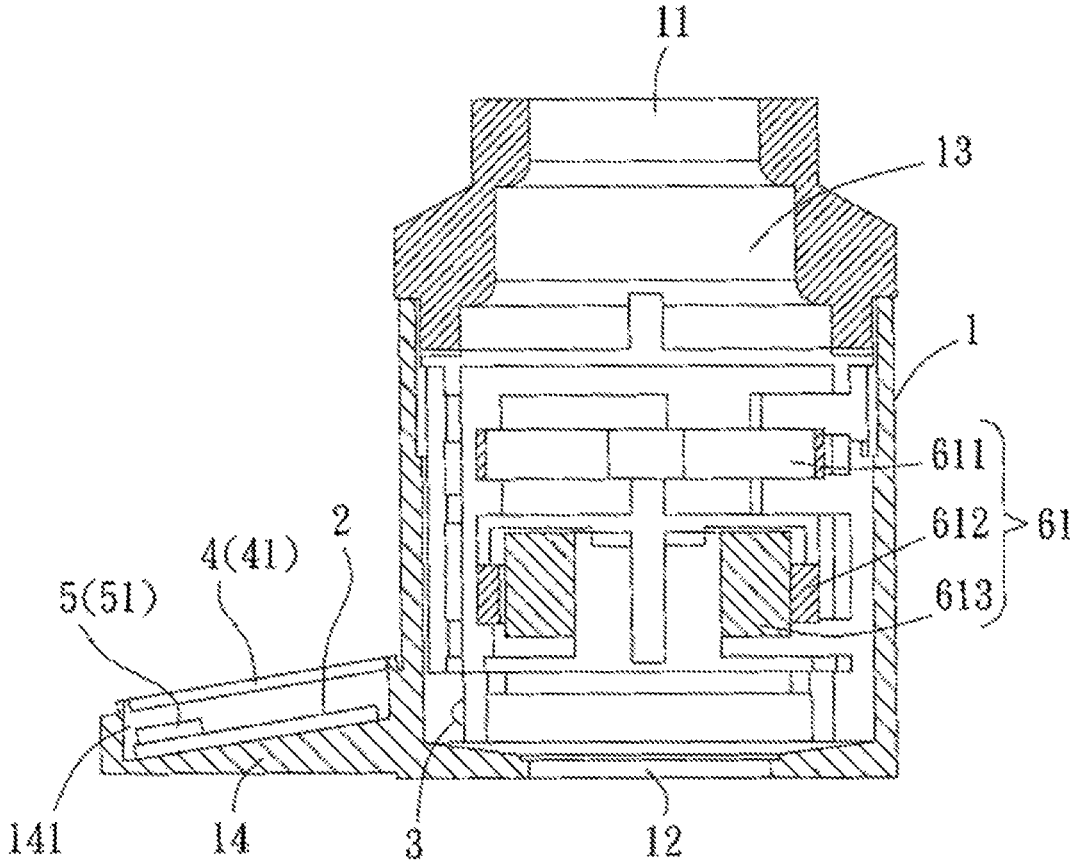
FIG. 2 is a cross-sectional view of a temperature displaying device for faucets or showerheads according to a preferred embodiment of the present invention.

As shown in FIG. 1 and FIG. 2, in a preferred embodiment of the present invention, the power supply module 6 comprises a water flow power generator 61 disposed in the water channel 13 of the pipe 1. The water flow power generator 61 comprises a hydraulic wheel 611, a rotor 612 coupled to the axis of the hydraulic wheel 611, and a stator 613 corresponding in position to the rotor 612. The hydraulic wheel 611 comprises axial blades or radial blades shown in FIG. 1 and FIG. 2 and is rotatably disposed in the water channel 13 of the pipe 1. The rotor 612 is a rotation module typically equipped with a coil. The stator 613 is a permanent magnet disposed between or around the coil of the rotor 612. The rotor 612 and the stator 613 are either disposed inside the water channel 13 of the pipe 1 or outside the water channel 13 of the pipe 1. Hence, the water running through the pipe 1 drives the hydraulic wheel 611 to rotate, and thus the hydraulic wheel 611 synchronously drives the rotor 612 to rotate, thereby causing the rotor 612 and the stator 613 to generate power to be supplied to the temperature displaying device of the present invention. The power generation principle of the rotor 612 and the stator 613 falls within the scope of well-known technology and thus is not described herein for the sake of brevity.

As shown in FIG. 1, in an embodiment of the present invention, the power supply module 6 further comprises a battery holder 62 for accommodating a battery. The battery holder 62 enables a battery to be connected to the control unit 2 for supplying power to the temperature displaying device of the present invention. In an embodiment of the present invention, the power supply module 6 further comprises a solar panel 63 for generating power to be supplied to the temperature displaying device of the present invention. The water flow power generator 61, the battery holder 62, and/or the solar panel 63 are/is selectively applied, in whatever desirable combination, to the implementation of the present invention to supply power to the temperature displaying device of the present invention.

Figure 3:
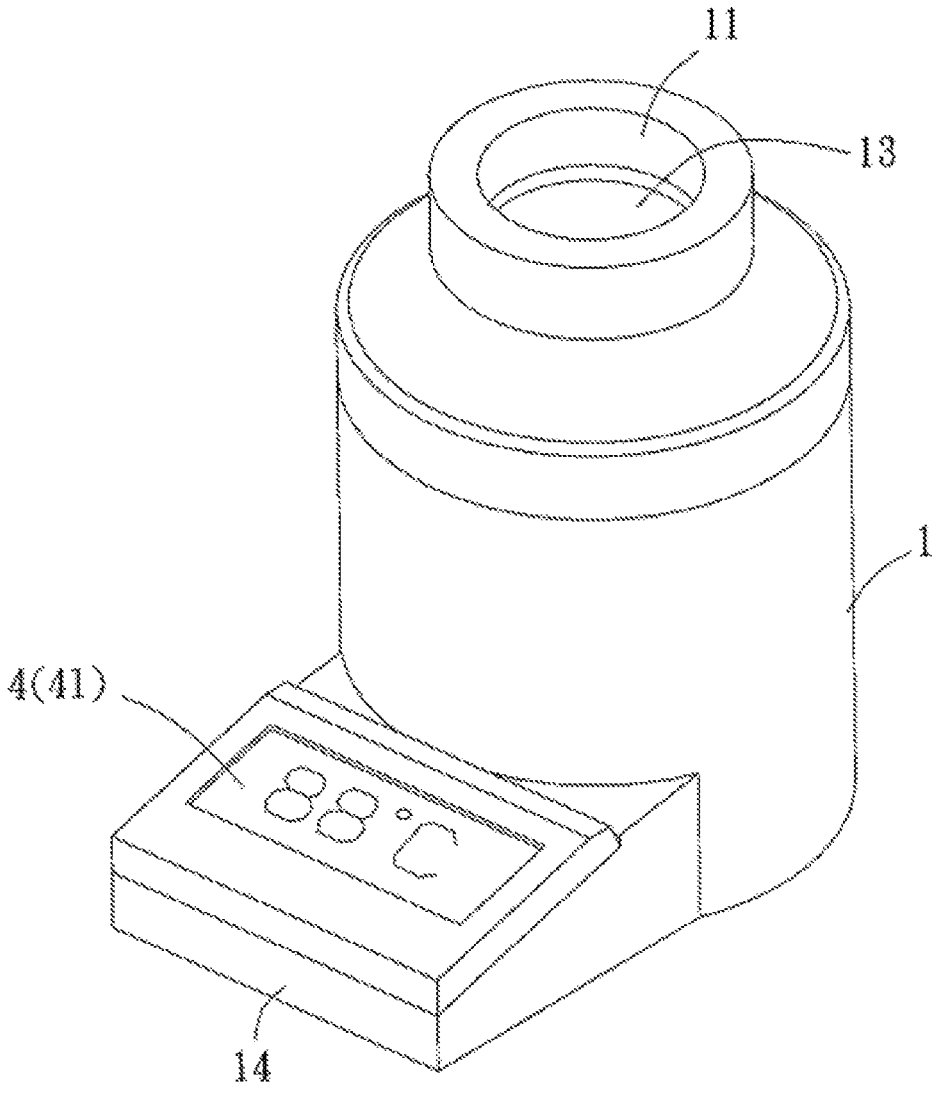
FIG. 3 is a perspective view of a temperature displaying device for faucets or showerheads according to a preferred embodiment of the present invention.

As shown in FIG. 2 and FIG. 3, in an embodiment of the present invention, the pipe 1 is integrally formed with a seat 14 protruding from the pipe 1 laterally. A receiving recess 141 is disposed deep in the seat 14. The control unit 2, the display unit 4 (the liquid crystal display 41), and the sound alert unit 5 (the buzzer 51) are disposed inside the receiving recess 141.

As shown in FIG. 1, in an embodiment of the present invention, the water inlet 11 of the pipe 1 can be quickly connected to or fitted inside the water outlet end of a conventional faucet or showerhead (not shown). Once the faucet or showerhead is turned on, water will pass through the water channel 13 of the pipe 1 and then flow out of the water outlet 12 of the pipe 1. Hence, the temperature displaying device of the present invention can be installed on an existing faucet or showerhead without dealing with the hassles of changing the existing faucet, thereby featuring ease of installation and ease of use. In addition, it is also feasible that the design of the temperature displaying device of the present invention is incorporated into a new product during a faucet or showerhead R&D stage to meet the requirement for integrated esthetical appearance. Once water runs through the water channel 13 of the pipe 1, the temperature sensing unit 3 will sense the temperature of the water running through the pipe 1 (the water channel 13) and then allow a sensing signal to be fed back to the control unit 2; afterward, under the control of the control unit 2, the liquid crystal display 41 of the display unit 4 displays the water temperature. The temperature displaying device of the present invention has a further advantage: if water temperature goes beyond a safe temperature threshold, the control unit 2 will drive the buzzer 51 of the sound alert unit 5 to give a sound alert for reminding a user of the water temperature. The control unit 2 will not stop driving the buzzer 51 of the sound alert unit 5 to give a sound alert unless and until the user lowers the water temperature to a safe temperature level. Hence, as disclosed in the present invention, the temperature displaying device for faucets or showerheads is effective in displaying water temperature and giving an alert in response to a high water temperature.

In an embodiment of the present invention, the water flow power generator 61 and/or the solar panel 63 of the power supply module 6 generates the power required to charge the temperature displaying device and the battery holder to meet the requirement for automatic power generation and operation, thereby enabling the temperature displaying device to maintain its displaying function.

Figure 4:
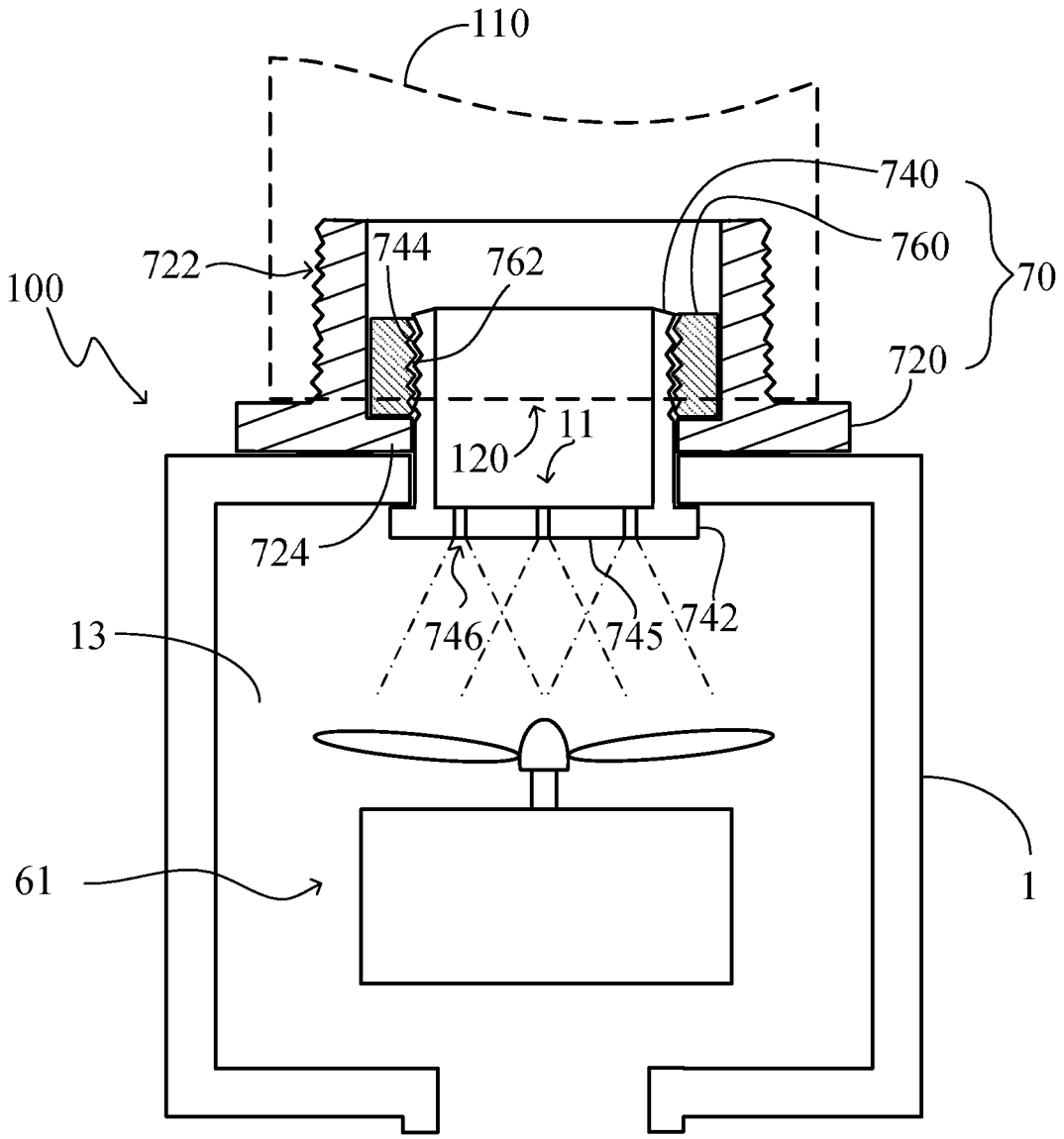
FIG. 4 is a schematic cross-sectional view illustrating a temperature displaying device coupled to a faucet or showerhead according to another embodiment of the present invention.
Figure 5:
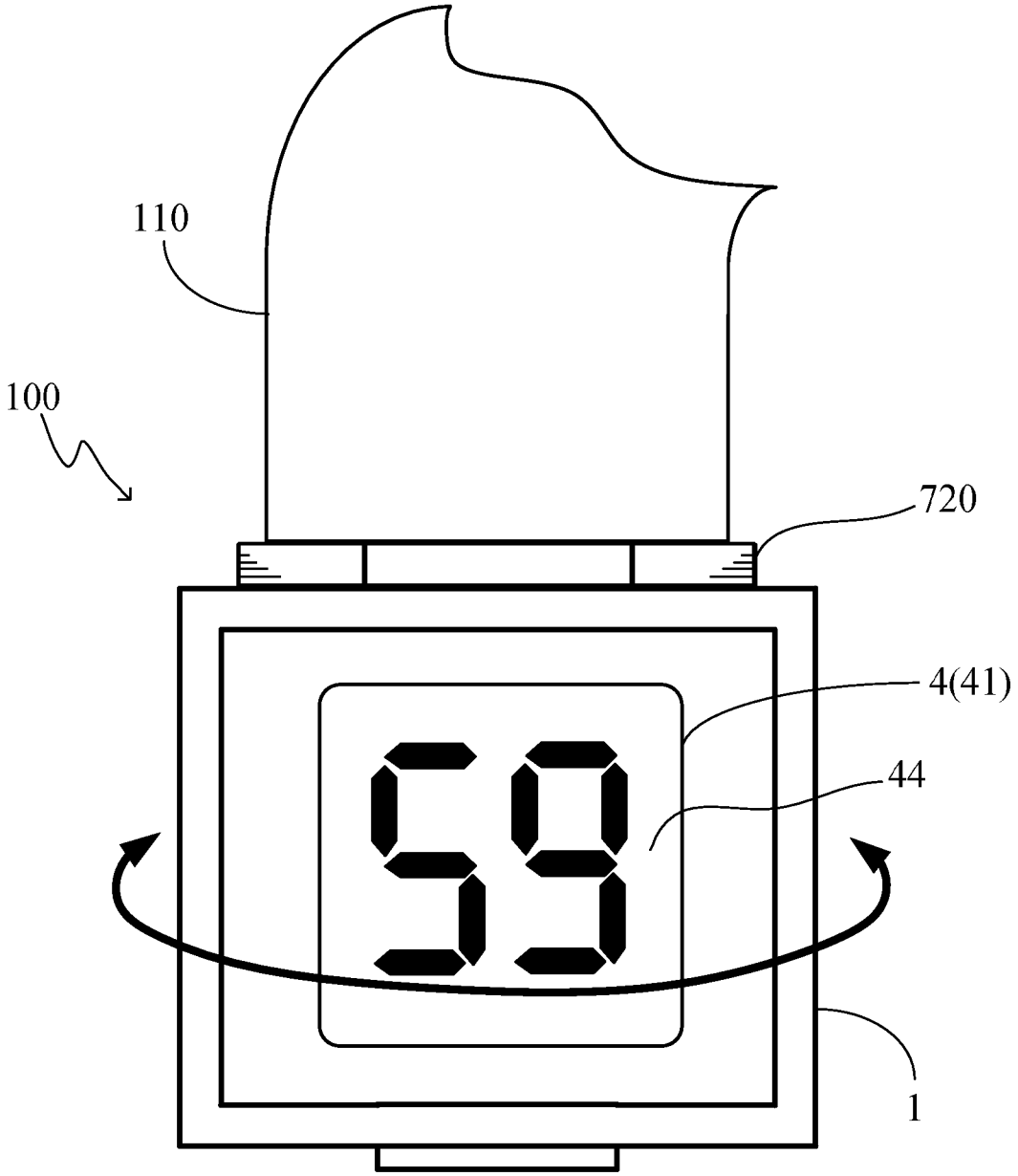
FIG. 5 is a front view of FIG. 4

For the convenience of the user to monitor the temperature from different angles, the temperature displaying device of the present invention further has a function that the pipe can be rotated for the user's convenience. Referring to FIGS. 4 and 5, FIG. 4 depicts a schematic cross-sectional view illustrating a temperature displaying device coupled to a faucet or showerhead according to another embodiment of the present invention; FIG. 5 is a front view of FIG. 4. The temperature displaying device 100 of the embodiment is a temperature displaying device which is mounted on an outlet 120 of a faucet 110 or showerhead (not shown) to monitor the temperature of the flow of the water. Except for the above-mentioned elements, the temperature displaying device 100 further includes a pipe connector 70. The pipe connector is utilized to provide a fluidic coupling between the faucet 110 or showerhead and the pipe 1, so that the temperature displaying device 100, which is located at the outlet 120 of the faucet 110 or showerhead, can be rotated without water leakage.

Specifically, the pipe connector 70 includes a pipe adapter 720, a sleeve 740, and a connecting ring 760. The pipe adapter 720 has an external thread 722 at an end thereof, and has a fastening member at an opposite end thereof. The external thread 722 is utilized to couple to the outlet 120 of the faucet 110 or showerhead. It should be noted that the outlet 120 of the faucet 110 or showerhead has an internal thread (not shown) corresponding to the external thread 722. That is to say, the temperature displaying device 100 of the present invention can be coupled to various outlets of the faucet 110 or showerhead by replacing the pipe adapter 720 with different external threads, without the production of a variety of the temperature displaying devices to adapt to the various faucets or showerheads.

Furthermore, the sleeve 740 is disposed at the water outlet 11, and the sleeve 740 has a flange 742 at an end of the sleeve 740 for engaging with the water channel 13 (i.e. an inner wall of the water inlet 11) of the pipe 1. An opposite end of the sleeve 740 is fixed at the fastening member 724 of the pipe adapter 720, so that the pipe 1 is capable of pivotable fixing in the outlet of the faucet or showerhead without water leakage.

More specifically, the sleeve 740 has a second external thread 744 at the opposite end of the sleeve 740. Correspondingly, the connecting ring 760 has an internal thread 762. The internal thread 762 is connected with the second external thread 744 of the sleeve 740 and fastened to the fastening member 720 of the pipe adapter 720. Accordingly, as shown in FIG. 4 and FIG. 5, the pipe 1 can be rotated around the sleeve 740 at the water inlet 11 so that the display unit 4 can be rotated toward any direction. As shown in FIG. 4, it is worth mentioning that the end of sleeve 740 can be a nozzle 745, which is utilized to reduce cross-sectional area of the water channel 13 for increase the flow rate, thereby enhancing the generated electrical energy of the water flow power generator 61. Preferably, as shown in FIG. 4, the nozzle 745 has a plurality of orifices 746. However, the present invention is not limited thereto.

Referring to FIG. 5 again, the display unit 4 of the embodiment is implemented by the liquid crystal display 41, and the liquid crystal display 41 further has a backlight 44. Similarly, the backlight 44 includes a light-emitting diode and a cold cathode fluorescent lamp, and the backlight 44 has at least two colors of light corresponding to the temperatures. For example, when the temperature of the water is less than 40 degrees, the control unit 2 controls the backlight 44 to emit green light; when the temperature of the water is greater than 40 degrees, the control unit 2 controls the backlight 44 to emit red light.

Hence, the present invention meets the three requirements of patentability, namely novelty, non-obviousness, and industrial applicability. Regarding novelty and non-obviousness, the present invention discloses a pipe, a control unit, a temperature sensing unit, a display unit, a sound alert unit, a power supply module, and a combination thereof whereby a temperature displaying device for faucets or showerheads can be easily installed at the water outlet end of a faucet or showerhead or can be easily installed inside a tube of the faucet or showerhead to display water temperature and give a high temperature-specific alert. Regarding industrial applicability, products derived from the present invention meet existing market demands fully.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A temperature displaying device mounted on an outlet of a faucet to monitor a temperature of a flow of water, comprising:

a pipe having a water inlet, a water outlet, and a water channel communicating with the water inlet and the water outlet;

a pipe connector for providing a fluidic coupling between the faucet and the pipe, the pipe connector comprising:

a pipe adapter having an external thread at an end of the pipe adapter for coupling to the outlet of the faucet, and having a fastening member at an opposite end of the pipe adapter; and a sleeve disposed at the water inlet, the sleeve having a flange at an end of the sleeve for engaging with the water channel of the pipe;

a control unit coupled to the pipe;

a temperature sensing unit coupled to the pipe and electrically coupled to the control unit for sensing the temperature of the water running through the pipe;

a display unit coupled to the pipe and electrically coupled to the control unit for displaying the temperature of the water; and a power supply module electrically connected to the control unit for supplying power to the temperature displaying device;

wherein the sleeve has a second external thread at an opposite end of the sleeve, and the pipe connector comprises a connecting ring having an internal thread connected with the second external thread of the sleeve and fastened to the fastening member of the pipe adapter.

2. The temperature displaying device of claim 1, wherein the power supply module comprises a water flow power generator disposed in the water channel of the pipe, the water flow power generator comprising a hydraulic wheel, a rotor coupled to the hydraulic wheel, and a stator corresponding in position to the rotor, such that water running through the pipe drives the hydraulic wheel to rotate and thereby causes the hydraulic wheel to synchronously drive the rotor to rotate, thereby allowing the rotor and the stator to generate power.

3. The temperature displaying device of claim 1, wherein the power supply module comprises a battery holder for accommodating a battery.

4. The temperature displaying device of claim 1, wherein the power supply module comprises a solar panel.

5. The temperature displaying device of claim 1, further comprising a sound alert unit which comprises a buzzer electrically connected to the control unit for giving a sound alert.

6. The temperature displaying device of claim 1, wherein the end of the sleeve is a nozzle.

7. The temperature displaying device of claim 1, wherein the display unit comprises a liquid crystal display.

8. The temperature displaying device of claim 7, wherein the liquid crystal display has a backlight.

9. The temperature displaying device of claim 8, wherein the backlight comprises a light-emitting diode and a cold cathode fluorescent lamp.

10. The temperature displaying device of claim 8, wherein the backlight has at least two colors of light corresponding to the temperatures.

* * * * *